US009689620B2

(12) United States Patent
Yamada et al.

(10) Patent No.: US 9,689,620 B2
(45) Date of Patent: Jun. 27, 2017

(54) HEAT EXCHANGER

(75) Inventors: Sayaka Yamada, Kobe (JP); Yasuo Higashi, Kobe (JP); Makoto Nishimura, Kobe (JP); Tatsuo Yoshida, Takasago (JP); Koji Noishiki, Takasago (JP)

(73) Assignee: Kobe Steel, Ltd., Hyogo (JP)

( * ) Notice: Subject to any disclaimer, the term of this patent is extended or adjusted under 35 U.S.C. 154(b) by 978 days.

(21) Appl. No.: 13/382,989

(22) PCT Filed: Jul. 9, 2010

(86) PCT No.: PCT/JP2010/061719

§ 371 (c)(1),
(2), (4) Date: Jan. 9, 2012

(87) PCT Pub. No.: WO2011/007737

PCT Pub. Date: Jan. 20, 2011

(65) Prior Publication Data

US 2012/0138266 A1 Jun. 7, 2012

(30) Foreign Application Priority Data

Jul. 14, 2009 (JP) ..... 2009-165220

(51) Int. Cl.
*F28F 3/00* (2006.01)
*F28D 7/02* (2006.01)
(Continued)

(52) U.S. Cl.
CPC ..... *F28D 9/0037* (2013.01); *F28D 9/0006* (2013.01); *F28F 3/048* (2013.01);
(Continued)

(58) Field of Classification Search
CPC ..... F28D 9/0006; F28D 9/0037; F28F 13/02; F28F 13/08
(Continued)

(56) References Cited

U.S. PATENT DOCUMENTS 1,922,838 A * 8/1933 Bossart ..... 165/177
2,663,321 A * 12/1953 Jantsch ..... 138/38
(Continued)

FOREIGN PATENT DOCUMENTS

JP U-61-96173 6/1986
JP 10-103888 4/1998
(Continued)

OTHER PUBLICATIONS

International Search Report in the corresponding patent application PCT/JP2010/061719 mailed Oct. 19, 2010.
(Continued)

*Primary Examiner* — Ryan J Walters
*Assistant Examiner* — Jason Thompson
(74) *Attorney, Agent, or Firm* — Studebaker & Brackett PC

(57) ABSTRACT

Disclosed is a heat exchanger that can more efficiently transfer heat between a heat-exchange fluid and an object with which heat is to be exchanged. A heat exchanger (1) can transfer heat between a heat-exchange fluid flowing through flow paths (R1) and a fluid with which heat is to be exchanged flowing through other flow paths (R2) by means of the flow path structure member (10) (a first metal sheet (11) and a second metal sheet (12)) in which the flow paths (R1 and R2) are formed. The flow paths (R1 and R2) are formed so that the side surfaces thereof are not straight and so that the depths thereof change along the flow direction.

6 Claims, 10 Drawing Sheets

(51) Int. Cl.

| | |
|---|---|
| ***F28F 3/14*** | (2006.01) |
| ***F28D 9/00*** | (2006.01) |
| ***F28F 3/04*** | (2006.01) |
| ***F28F 13/08*** | (2006.01) |
| ***F28F 13/12*** | (2006.01) |
| ***F28F 13/02*** | (2006.01) |

(52) U.S. Cl.
CPC ..... *F28F 13/02* (2013.01); *F28F 13/08* (2013.01); *F28F 13/12* (2013.01)

(58) Field of Classification Search
USPC ..... 165/166, 109.1, 177, 146, 181, 170, 168
See application file for complete search history.

(56) References Cited

U.S. PATENT DOCUMENTS

| | | | | |
|---|---|---|---|---|
| 3,151,675 | A * | 10/1964 | Lysholm | 165/166 |
| 3,498,372 | A * | 3/1970 | Collins et al. | 165/166 |
| 4,420,039 | A * | 12/1983 | Dubrovsky | 165/166 |
| 5,009,263 | A * | 4/1991 | Seshimo et al. | 165/151 |
| 6,000,466 | A * | 12/1999 | Aoyagi | F28F 1/40 165/133 |
| 6,305,834 | B1 * | 10/2001 | Schubert et al. | 366/144 |
| 7,017,651 | B1 * | 3/2006 | Wilson et al. | 165/47 |
| 2001/0006105 | A1 * | 7/2001 | Watanabe et al. | 165/177 |
| 2004/0184237 | A1 * | 9/2004 | Chang | 361/699 |
| 2006/0243429 | A1 * | 11/2006 | Chu et al. | 165/109.1 |
| 2007/0062674 | A1 * | 3/2007 | Ippoushi et al. | 165/80.4 |
| 2007/0234567 | A1 * | 10/2007 | Noishiki et al. | 29/890.03 |
| 2008/0047696 | A1 * | 2/2008 | Sperandei et al. | 165/109.1 |
| 2013/0153184 | A1 * | 6/2013 | Rolt et al. | 165/166 |

FOREIGN PATENT DOCUMENTS

| | | | |
|---|---|---|---|
| JP | 11-337276 | | 12/1999 |
| JP | 2005-106412 | | 4/2005 |
| JP | 2006-170549 | | 6/2006 |
| JP | 2007-101168 | | 4/2007 |
| WO | WO 2009130984 | A1 * | 10/2009 |
| WO | WO2011/007737 | | 1/2011 |

OTHER PUBLICATIONS

Office Action issued from Japanese Patent Office, in corresponding Japanese Patent Application No. 2009-165220, dated Aug. 28, 2012, 2 pages in Japanese, and 3 pages in its English translation.

* cited by examiner

HEAT EXCHANGER

TECHNICAL FIELD

The present invention relates to a heat exchanger, capable of performing heat exchange between a heat-exchange fluid flowing through a flow path and a heat-exchange object outside the flow path.

BACKGROUND ART

A heat exchanger is conventionally developed, which includes flow paths, which a heat-exchange fluid passes through, and which are formed on surfaces of sheet metals, such as stainless steel plates or aluminum plates, by means of etching technique or the like. As such a heat exchanger, a heat exchanger described in Patent Literature 1 is known, for example.

This heat exchanger is constituted by alternately stacking metal sheet-like plates each provided with a plurality of heat transfer fins. A flow path for heat-exchange fluid is formed between each of the two opposed metal sheet-like plates. In the thus-constituted heat exchanger, each of the heat transfer fins is formed such that it has a cross-section that is curved from its front end to its rear end, and the area of a flow path for a fluid, which flows between the heat transfer fins, is substantially constant.

This structure can minimize pressure loss due to contracted flow or expanded flow of the heat-exchange fluid flowing through the flow path. Further, the pressure loss of the heat-exchange fluid can be minimized while reduction in size and cost of the heat exchanger are maintained, and the heat transfer performance of the heat exchanger is not impaired.

CITATION LIST

Patent Literature

[PATENT LITERATURE 1] Japanese Patent Application Laid-Open No. 2006-170549

SUMMARY OF INVENTION

Technical Problem

However, when side surfaces of a flow path, through which a heat-exchange fluid passes, are curved as described in Patent Literature 1, a flow opposite to a main flow (vortex) is apt to be locally generated inside the flow path, compared with a case in which side surfaces of a flow path are formed straight. This may interfere with the transfer of heat from a heat-exchange fluid, which flows through a flow path, to a heat-exchange object outside the flow path.

In view of the above-mentioned circumstance, the present invention has an object to provide a heat exchanger, capable of more efficiently performing heat exchange between a heat-exchange fluid and a heat-exchange object.

Solution to Problem

A first aspect of the present invention provides a heat exchanger, capable of performing heat exchange between a heat-exchange fluid flowing through a flow path having a pair of opposing side surfaces and a heat-exchange object located outside the flow path, in which the flow path is formed such that the distance between the pair of side surfaces is changed along the flow direction, and formed such that the depth of the flow path becomes smaller with the distance being larger, and the depth of the flow path becomes larger with the distance being smaller.

This structure can increase the area for the heat transfer from the heat-exchange fluid to the flow path structure member, and suppress a thermal boundary layer from developing in a flow flowing along inner surfaces of the flow path.

Further, by changing the depth of the flow path in relation to a change in the distance between the side surfaces, vortexes, generated over wide ranges due to the change in the distance, can be more surely suppressed.

Thus, the heat exchanger according to the present invention can more efficiently perform the heat exchange between the heat-exchange fluid and the heat-exchange object.

According to a second aspect of a heat exchanger of the present invention, the flow path is formed such that the area of a cross section orthogonal to the flow direction is constant.

This structure can suppress contracted flow or expanded flow of the heat-exchange fluid flowing through the flow path, and the generation of vortexes, compared with a structure in which the cross-sectional area of the flow path changes along the flow direction.

Advantageous Effects of Invention

The present invention enables more efficient heat exchange between a heat-exchange fluid and a heat-exchange object.

DESCRIPTION OF EMBODIMENTS

Hereinafter, a preferred embodiment for carrying out the present invention will be described with reference to the accompanying drawings.

(Overall Structure)

Figure 1:
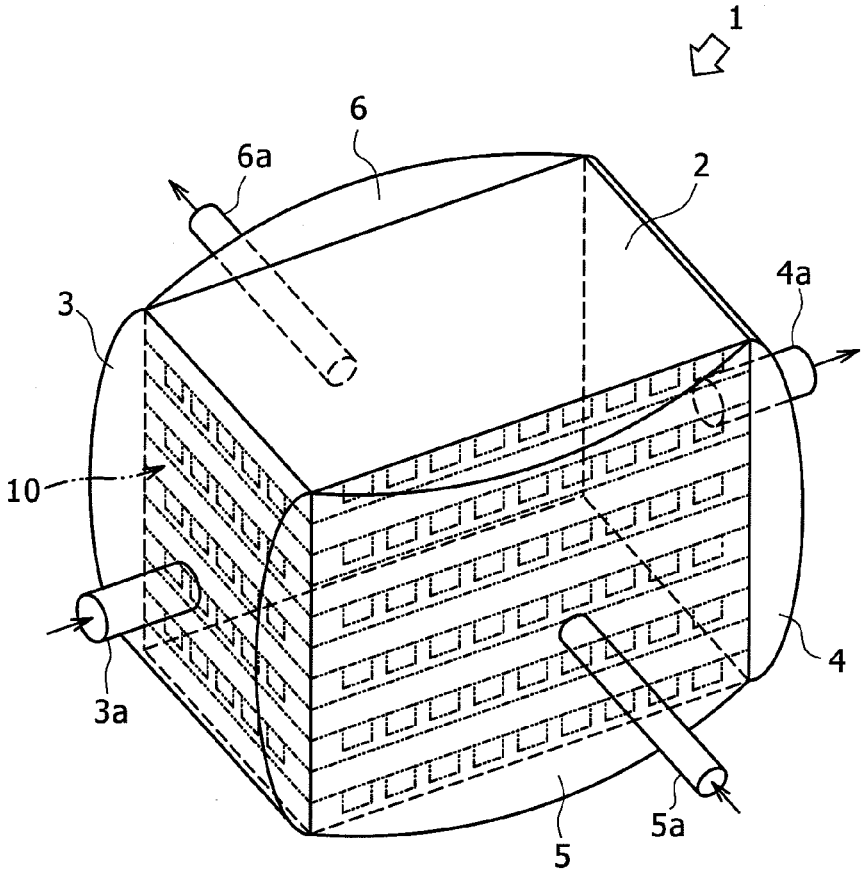
FIG. 1 is an overall view showing a heat exchanger according to an embodiment of the present invention.
Figure 2:
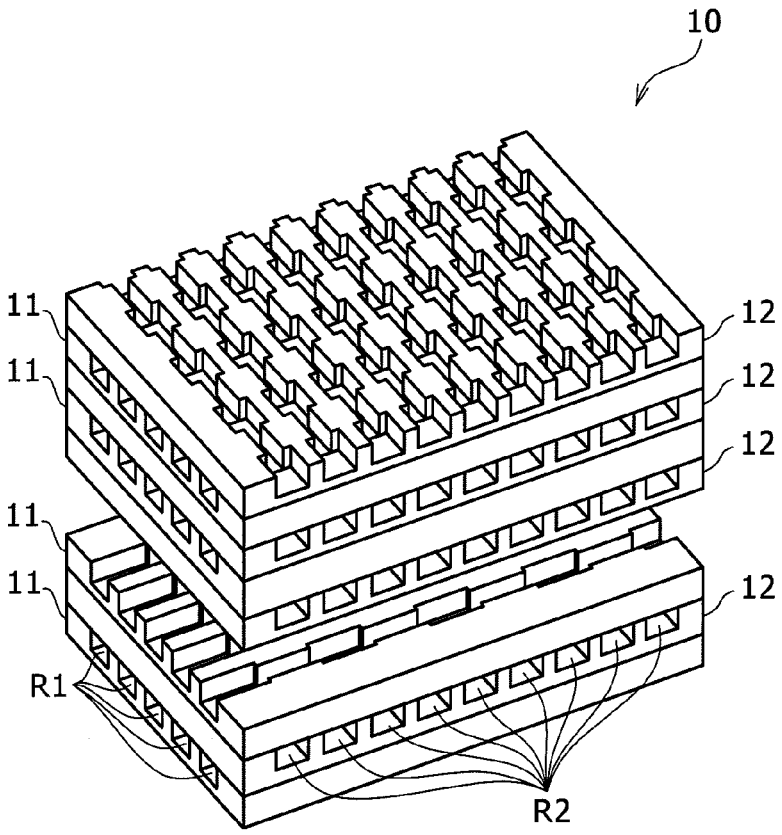
FIG. 2 is a view showing a state, in which metal sheets are stacked within the heat exchanger of FIG. 1.

As shown in FIG. 1, in a heat exchanger 1 according to the present embodiment, a body 2 is formed substantially in a rectangular parallelepiped box shape. A flow path structure member 10, shown in FIG. 2, is provided inside the body 2.

The flow path structure member 10 is formed by alternately stacking a plurality of first metal sheets 11 and second metal sheets 12. As the first metal sheet 11 and the second metal sheet 12, stainless steel plate can be used, for example.

The first metal sheet 11 is a rectangular thin plate having a plurality of flow paths R1 (grooves) on a surface thereof. The plurality of flow paths are formed such that they extend along the longitudinal direction of the rectangular thin plate.

The second metal sheet 12 is a rectangular thin plate having the same size as the first metal sheet 11. A plurality of flow paths R2 (grooves) are formed on a surface of the second metal sheet 12 such that they extend along a direction orthogonal to the flow paths formed in the first metal sheet 11 (along the short side direction of the rectangular thin plate).

Surfaces which constitute the flow paths R1, R2 and are located along a direction orthogonal to the flow direction are entirely covered by side surfaces and a bottom surface of a groove (flow path) formed in a metal sheet, and a lower surface of another metal sheet stacked on the metal sheet.

The body 2 of the heat exchanger 1 includes a first supply header 3, a first discharge header 4, a second supply header 5, and a second discharge header 6, and these headers form the side surfaces of the body 2.

A heat-exchange fluid, such as cold water, is supplied to the first supply header 3 through a supply pipe 3*a*. The heat-exchange fluid is distributed to the plurality of flow paths R1, formed in each of the plurality of first metal sheets 11, through the first supply header 3.

The heat-exchange fluid supplied from the first supply header 3 flows into the first discharge header 4, which will be described later, through the plurality of flow paths R1, formed in the first metal sheet 11.

The first discharge header 4 is provided on the body 2 so as to form the side surface opposed to the first supply header 3. The heat-exchange fluid discharged from the plurality of flow paths R1, formed in the first metal sheet 11, is supplied to the first discharge header 4. This heat-exchange fluid is discharged through a discharge pipe 4*a*, provided for the first discharge header 4.

A fluid that is an object to be heat-exchanged with the heat-exchange fluid (hereinafter referred to as object fluid) is supplied to the second supply header 5 through a supply pipe 5*a*. This object fluid is distributed to the plurality of flow paths R2, formed in each second metal sheet 12, through the second supply header 5.

The object fluid supplied from the second supply header 5 flows into the second discharge header 6, which will be described later, through the plurality of flow paths R2, formed in the second metal sheet 12. Thereby, heat exchange is performed, through the flow path structure member, between the object fluid flowing in the flow paths, formed in the second metal sheet 12, and the heat-exchange fluid flowing in the flow paths, formed in the first metal sheet 11.

The second discharge header 6 is provided on the body 2 to form the side surface opposed to the second supply header 5. The object fluid discharged from the plurality of flow paths, formed in the second metal sheet 12, is supplied to the second discharge header 6. This object fluid is discharged through a discharge pipe 6*a*, provided for the second discharge header 6.

(Detail of Flow Paths)

Figure 3A:
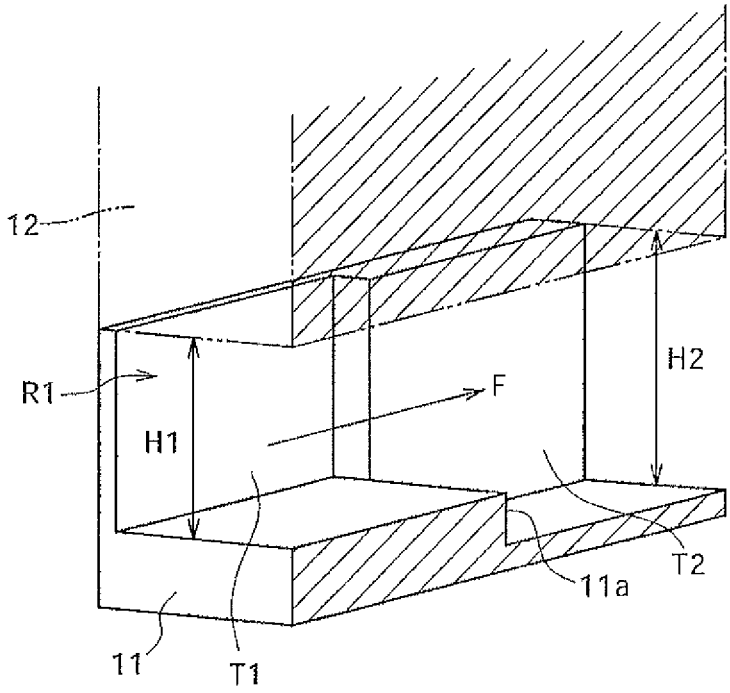
FIG. 3 illustrate a flow path formed in the metal sheets of FIG. 2, wherein (a) and (b) are a partial cross-sectional view and a plan view thereof respectively.
Figure 3B:
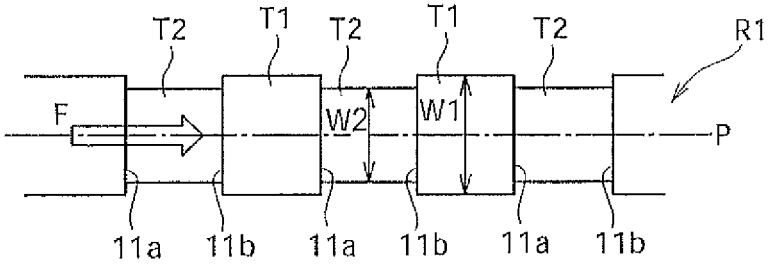

FIG. 3 illustrate a flow path R1, formed in the first metal sheet 11 of FIG. 2, wherein (a) and (b) are a partial cross-sectional view and a plan view thereof respectively.

As shown in FIG. 3(*b*), the flow path R1 extends linearly along a center line P (flow path center line P), which passes through a width-directional center in planar view. Irregularities are formed on side surfaces of the flow path R1, so that the distance between both the side surfaces changes along a flow direction parallel to the flow path center line P (the direction of arrow F).

Concretely, a recessed area T1, having a distance W1 between both side surfaces, and a protruding area T2, having a distance W2, which is smaller than W1, between both side surfaces, are alternately arranged along the flow direction. The recessed area T1 and the protruding area T2 have the same flow-directional length. Both the side surfaces of the flow path R1 are provided to be symmetric, in planar view, relative to the flow path center line P extending along the flow direction.

The recessed area T1 and the protruding area T2 are not only configured to have the same flow-directional length, but also can be configured to have different flow-directional lengths.

As shown in FIG. 3(*a*), the flow path R1 is formed such that its depth is differed between the recessed area T1 and the protruding area T2. Concretely, in the flow path R1, the depth in the protruding area T2 is larger than the depth in the recessed area T1. Namely, a stepped portion 11*a* is provided at a position, where the recessed area T1 is shifted to the protruding area T2, along the flow direction. The stepped portion 11*a* is formed such that the downstream side (the protruding area T2 side) is lower in level than the upstream side (the recessed area T1 side). In addition, a stepped portion 11*b* is provided at a position, where the protruding area T2 is shifted to the recessed area T1, along the flow direction. The stepped portion 11*b* is formed such that the downstream side (the recessed area T1 side) is higher in level than the upstream side (the protruding area T2 side).

The above-mentioned stepped portions 11*a*, 11*b* are continuous over the whole area, along the width direction, of the flow path R1.

In the present embodiment, the flow path R1 is formed such that the area of the cross-section, vertical to the flow direction in the flow path R1, of the flow path R1 is the same for both the recessed area T1 and the protruding area T2. Namely, assuming that the height from the bottom surface of the flow path R1 to the lower surface of the second metal sheet 12, stacked on the first metal sheet 11, in the recessed area T1 is H1 and assuming that the height in the protruding area T2 is H2, the following expression (1) is established.

$$H1 \times W1 = H2 \times W2 \quad (1)$$

The flow path R1 can be formed, for example, by etching the surface of the metal sheet. The irregularities on the bottom surface of the flow path can be formed by changing the corrosion time for each area by use of a mask or the like.

The description for the shape of the flow path R2 formed in the second metal sheet 12 is omitted since it has substantially the same shape as that of the flow path R1 formed in the first metal sheet 11.

The length along the flow direction, depth, width between both side surfaces and the like of the recessed area and protruding area in the flow path R2 may be configured differently from those in the flow path R1 formed in the first metal sheet 11.

(Analysis of Flow Line Inside Flow Path)

Figure 4:
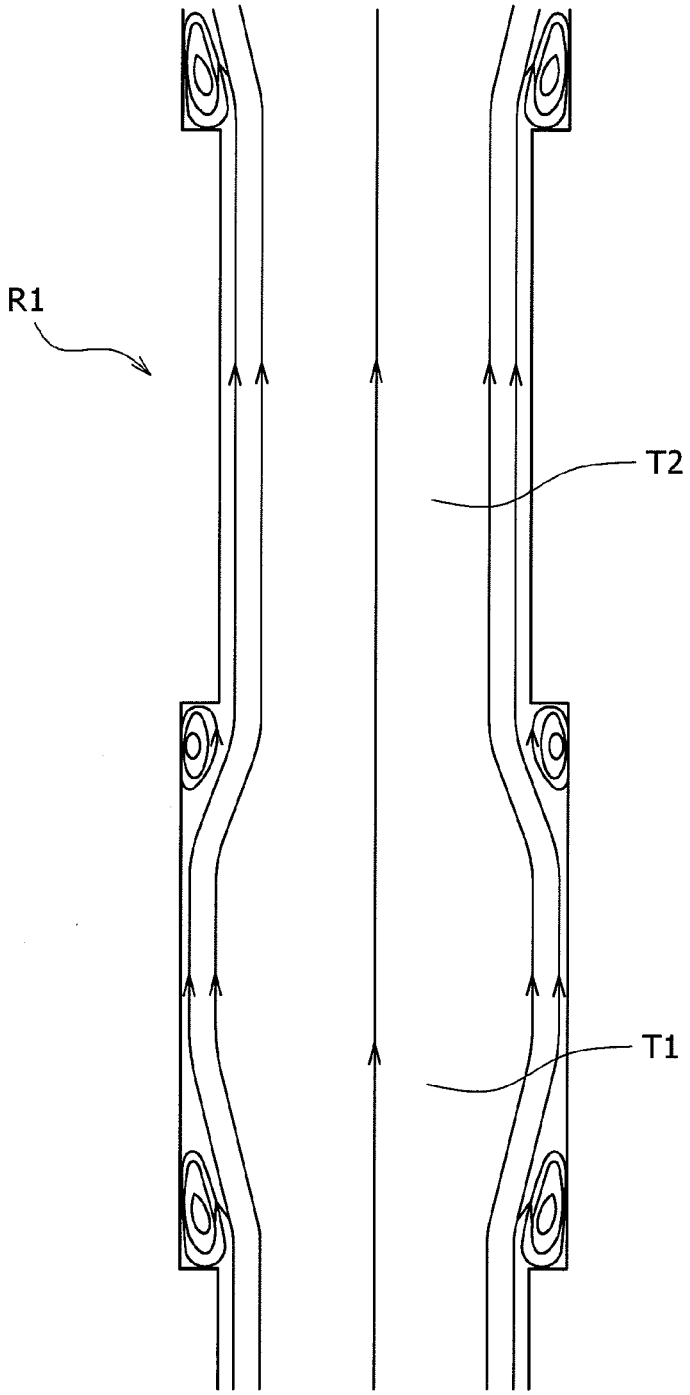
FIG. 4 is a view showing a result of an analysis for a flow inside the flow path of FIG. 3.

FIG. 4 shows an analysis result (flow line view) obtained by analyzing the flow within the flow path R1 shown in FIGS. 3(*a*), (*b*).

FIG. 4 is a flow line view under the condition that the Reynolds number Re of the heat-exchange fluid flowing in the flow path R1 is 500.

The Reynolds number Re is defined by the following expression (2).

$$Re=uD/\nu \quad (2)$$

In the expression (2), u: flow velocity of heat-exchange fluid, D: hydraulic diameter based on narrow flow path width, and ν: kinematic viscosity coefficient of heat-exchange fluid.

Figure 5:
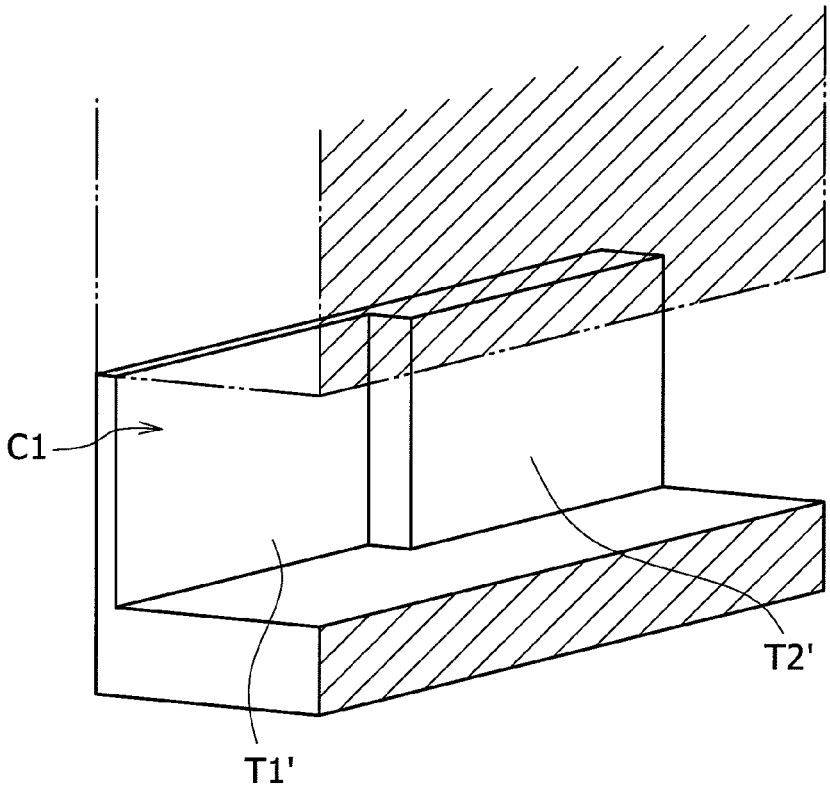
FIG. 5 is a partial cross-sectional view showing a flow path of a comparative example.
Figure 6:
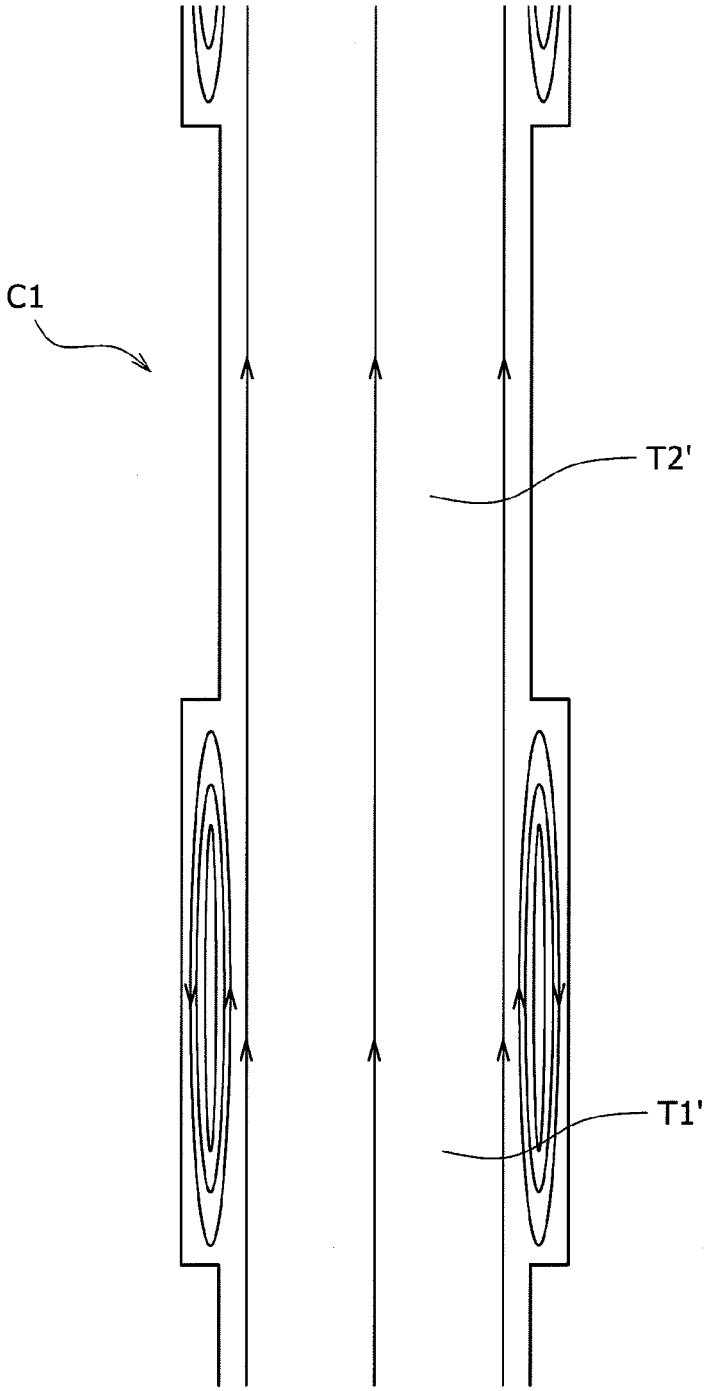
FIG. 6 is a view showing a result of an analysis for a flow inside the flow path of the comparative example of FIG. 5.

For comparison, FIG. 6 shows an analysis result (flow line view) obtained by analyzing the flow within a flow path C1 of a comparative example shown in FIG. 5 under the same condition. The flow path C1 of the comparative example includes a flat bottom surface without irregularities but its other structure is the same as that of the flow path R1 of the present embodiment shown in FIG. 3, and thus the flow path C1 includes a recessed area T1' and a protruding area T2'.

In the flow path C1 of the comparative example, as shown in FIG. 6, vortexes, which circulate over the substantially whole area, along the flow direction, of the recessed area T1', are generated in the vicinity of both side surfaces of the recessed area T1'. In this case, the efficiency of heat exchange between the heat-exchange fluid and the flow path structure member is seriously deteriorated at both the side surfaces of the recessed area T1'.

On the other hand, in the flow path R1 of the present embodiment, as shown in FIG. 4, vortexes are generated only in the vicinity of corners, which are boundaries between the recessed area T1 and the protruding area T2, in the recessed area T1. Namely, in the vicinity of both side surfaces of the flow-directional center of the recessed area T1, no vortex is generated, and the heat-exchange fluid flows substantially in the flow direction similarly as in the width-directional center of the flow path R1. In this case, since the opposite flow is minimized in the vicinity of the side surfaces of the flow path R1, the efficiency of heat exchange between the heat-exchange fluid and the flow path structure member can be improved.

(Analysis Result on Heat Transfer Characteristic, etc.)

Figure 7:
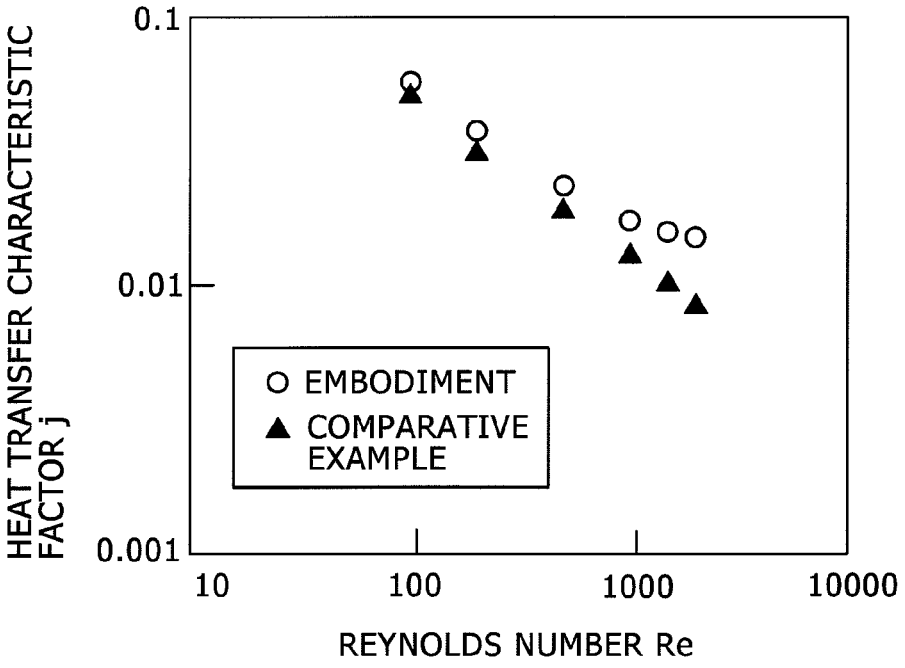
FIG. 7 is a view showing relationships between Reynolds number and factor j, which indicates heat transfer characteristic, of fluids flowing in the flow paths of FIGS. 3 and 5.
Figure 8:
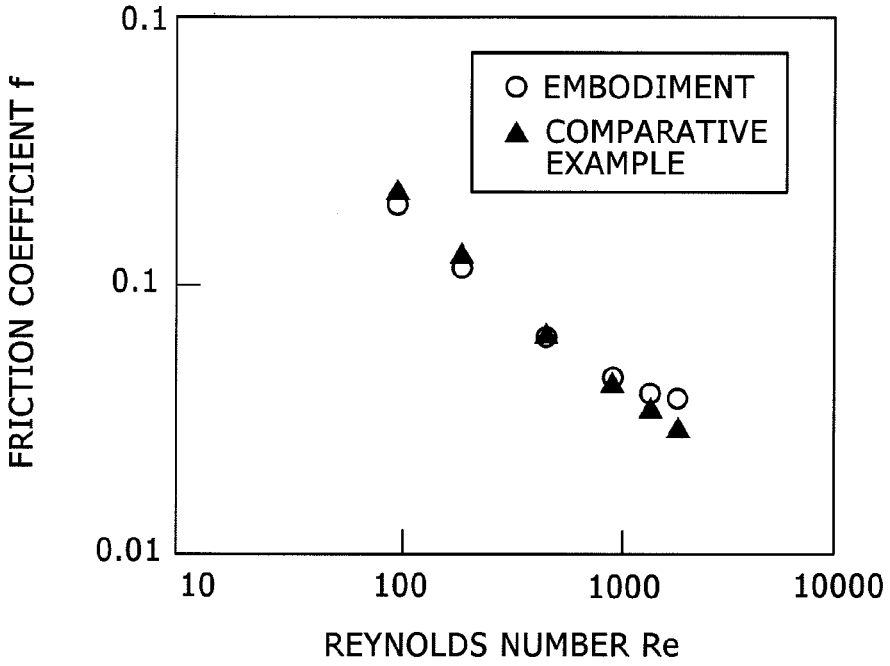
FIG. 8 is a view showing relationships between Reynolds number and friction coefficient f of the fluids flowing in the flow paths of FIGS. 3 and 5.
Figure 9:
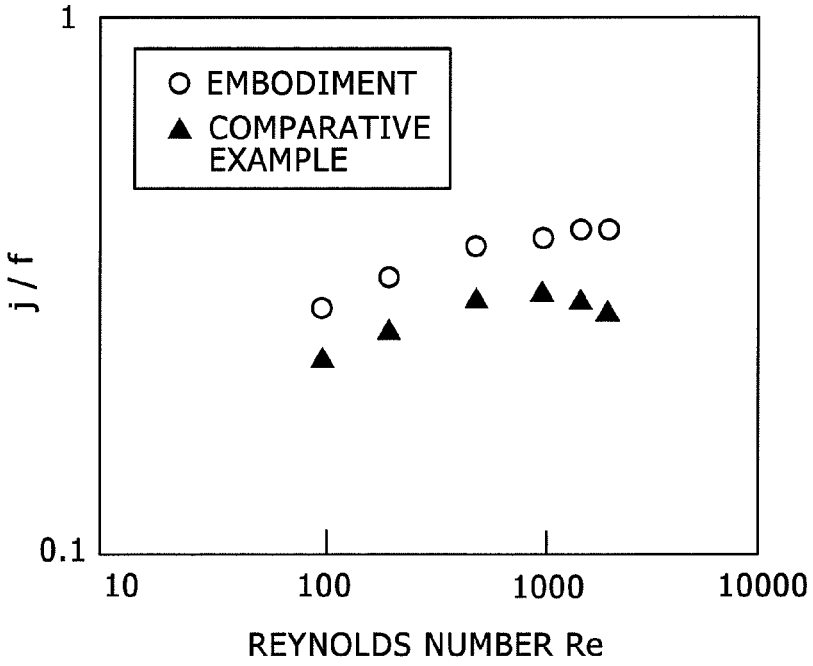
FIG. 9 is a view showing relationships between Reynolds number and j/f of the fluids flowing in the flow paths of FIGS. 3 and 5.

With respect to the flow path R1 (refer to FIG. 3) in the heat exchanger 1 of the present embodiment and the flow path C1 (refer to FIG. 5) in the comparative example, an analysis result on the relationship between the Reynolds number Re of the fluid flowing in each flow path and a factor j indicating heat transfer characteristics is shown in FIG. 7. An analysis result on the relationship between the Reynolds number Re of the heat-exchange fluid flowing in the flow path and a friction coefficient f is shown in FIG. 8. Further, an analysis result on the relationship between the Reynolds number Re of the fluid flowing in the flow path and a value (j/f) is shown in FIG. 9.

The factor j is determined by analysis based on the following expressions (3) and (4). The factor j indicates heat transfer characteristics, and becomes higher with heat transfer characteristics from the fluid, flowing in the flow path, to the flow path structure member being higher.

[Mathematical Formula 1]

$$j=Nu/Re\times Pr^{1/3} \quad (3)$$

$$Nu=h\times d/k \quad (4)$$

In the expressions (3), (4), Nu: Nusselt number, Re: Reynolds number, Pr: Prandtl number, h: heat-transfer coefficient between fluid and flow path structure member, k: thermal conductivity of fluid, and d: hydraulic diameter.

The friction coefficient f is determined based on the following expression (5), and becomes larger with pressure loss of the fluid, passing inside the flow path, being higher.

[Mathematical Formula 2]

$$\Delta P=4\times f\times L/d\times(\rho\times u^2)/2 \quad (5)$$

In the expression (5), ΔP: pressure loss, u: flow velocity, d: hydraulic diameter, ρ: density of fluid, and L: flow path length.

As shown in FIG. 7, regardless of the value of the Reynolds number Re, the value of the factor j in the present embodiment is larger than that in the comparative example. Namely, this shows that the flow path R1 of the present embodiment has heat transfer characteristics more excellent than those of the flow path C1 of the comparative example.

On the other hand, when the Reynolds number Re exceeds 1,000 as shown in FIG. 8, the value of the friction coefficient f in the present embodiment is slightly larger than the value in the comparative example, but the difference is small.

As a result of this, as shown in FIG. 9, the value of j/f in the present embodiment is larger than that in the comparative example regardless of the value of the Reynolds number Re. Namely, it is found that the pressure loss is slightly increased in the flow path R1 of the present embodiment compared with the flow path C1 of the comparative example, however the increase ratio of the pressure loss is smaller than the increase ratio of heat transfer characteristics.

In this way, according to the flow path R1 of the present embodiment, the heat transfer characteristics can be improved without excessive increase in pressure loss.

(Effect of Present Embodiment)

(1) As has been described, according to the heat exchanger 1 of the present embodiment, heat exchange can be performed, through the flow path structure member 10 (the first metal sheet 11 and the second metal sheet 12) constituting the flow path R1 and the flow path R2, between the heat-exchange fluid flowing in the flow path R1 and the object fluid flowing in the flow path R2.

The flow path R1 and flow path R2 are formed such that irregular side surfaces are formed so that flows along the side surfaces become nonlinear. In addition, the flow path R1 and flow path R2 are formed such that the distance between a pair of opposing side surfaces and the depth change along the flow direction.

This structure can increase the area for the heat transfer from the heat-exchange fluid to the flow path structure member 10, and suppress a thermal boundary layer from developing in the flow in the vicinity of the side surfaces and bottom surface. Further, compared with the comparative example shown in FIGS. 4 and 6, the heat exchanger 1 of the present embodiment can limit the generation of vortexes to a predetermined range, in planar view, in the flow path R1. It should be noted that the same effect can be achieved for the flow path R2. Thus, the heat exchanger 1 of the present embodiment can more efficiently perform the heat exchange between the heat-exchange fluid and the object fluid.

The flow path R1 and flow path R2 are not only formed such that side surfaces and bottom surface have stepwise shape but also may be formed such that they have smoothly curved shape along the flow direction.

The flow path R1 of the heat exchanger 1 is formed such that its depth (H1, H2) becomes smaller with a distance (W1, W2) between a pair of opposing side surfaces being larger, and becomes larger with the distance (W1, W2) being smaller.

In the heat exchanger 1 of the present embodiment, the flow path R2, in which the object fluid flows, is formed in the same manner.

The structure, in which the distance between side surfaces is changed along the flow direction, of the present embodiment can more surely suppress vortexes over a wide range from generating, and enables more efficient heat exchange between the heat-exchange fluid and the object fluid.

(2) The flow path R1 of the heat exchanger 1 is formed such that the area of its cross section orthogonal to the flow direction is constant. In the heat exchanger 1, the flow path R2, through which the object fluid flows, is formed in the same manner.

According to this structure, since the cross section orthogonal to the flow direction of the flow path is constant, contracted flow or expanded flow of the heat-exchange fluid flowing in the flow path can be suppressed, and pressure loss due to the contracted flow or expanded flow can be suppressed.

Further, compared with a structure in which a cross-sectional area of a flow path is changed along the flow direction, the present embodiment can suppress the generation of the vortexes, and enables more efficient heat exchange between the heat-exchange fluid and the object fluid.

The preferred embodiment of the present invention has been described above. However, the present invention is never limited by the above-described embodiment, but can be variously modified and carried out within the scope of the claims.

For example, the present invention can be modified and carried out, as described below.

Figure 10:
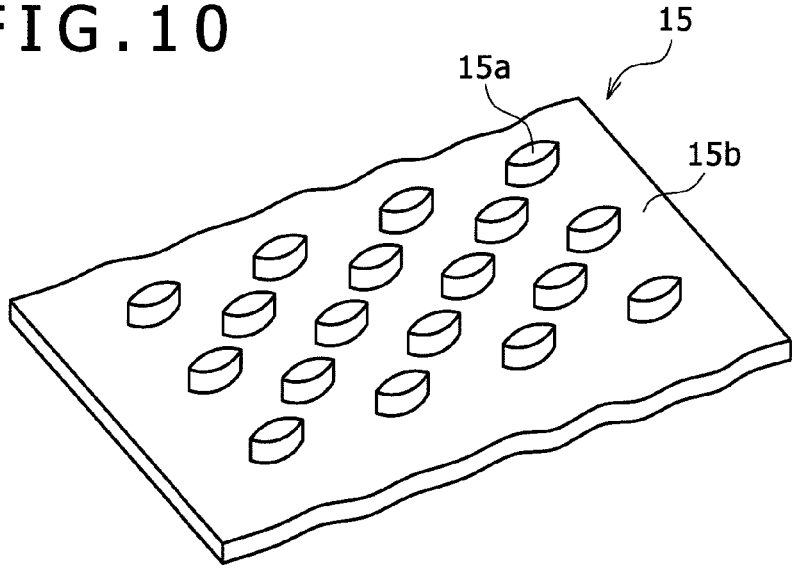
FIG. 10 is a view showing a metal sheet of a heat exchanger according to a modified example of the present embodiment.
Figure 11A:
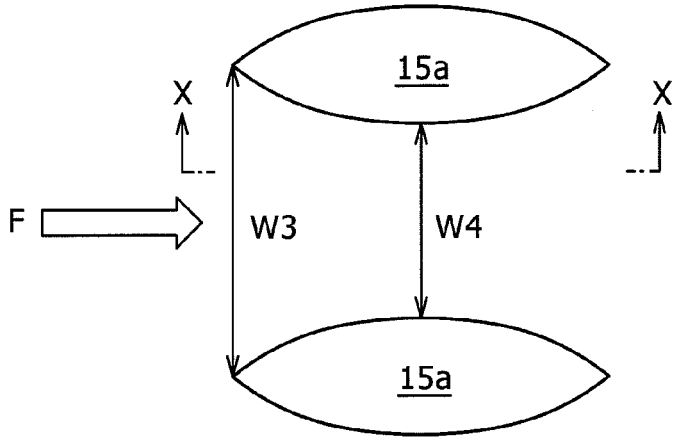
FIG. 11 illustrate a flow path formed in the metal sheet shown in FIG. 10, wherein (a) and (b) are a plan view and a cross-sectional view taken along line X-X in (a) respectively.
Figure 11B:
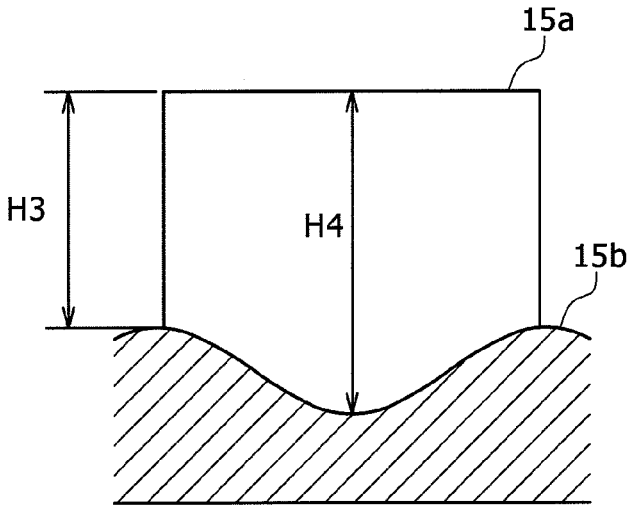

(1) FIG. 10 shows one of a plurality of metal sheets stacked within a body of a plate fin type heat exchanger according to a modified example of the present embodiment. FIG. 11(*a*) is a plan view of a flow path formed in the metal sheet shown in FIG. 10. FIG. 11(*b*) is a cross-sectional view taken along line X-X of the flow path shown in FIG. 11(*a*).

In the modified example, a plurality of columns 15*a*, each has airfoil shape in planar view, are formed on a metal sheet 15 by etching or the like, whereby a flow path is formed between the columns 15*a*. As shown in FIG. 11(*a*), when a plurality of the metal sheets 15 are stacked, the heat-exchange fluid passes between the airfoil columns 15*a* along a direction shown by arrow F. As shown in FIG. 11(*b*), on a bottom surface 15*b* of this flow path, wavy irregularities are periodically formed along the flow direction of the heat-exchange fluid.

Concretely, the airfoil columns 15*a* are formed such that the flow path has the smallest depth (shown by height H3 in FIG. 11(*b*)) at its portion where the distance between columns 15*a* which are adjacent to each other along the direction orthogonal to the flow direction has the largest value along the flow direction (its portion having width W3 in FIG. 11(*a*)). The flow path is formed such that the flow path has the largest depth (shown by height H4 in FIG. 11(*b*)) at its portion where the distance between columns 15*a* which are adjacent to each other in the direction orthogonal to the flow direction has the smallest value along the flow direction (its portion having width W4 in FIG. 11(*a*)). In this way, the flow path is constituted such that the area of the flow path between the adjacent columns 15*a* (the area of a cross-section, orthogonal to the flow direction, of a flow path) is unchanged along the flow direction, whereby the heat transfer performance can be further improved.

(2) The heat exchanger of the above-mentioned embodiment is for heat exchange between a heat-exchange fluid, passing through flow paths formed in first metal sheets, and an object fluid, passing through flow paths formed in second metal sheets sandwiched between the first metal sheets, however, its purpose is not limited thereto. Namely, the heat exchanger may perform heat exchange between a solid heat-exchange object and a heat-exchange fluid, for example, by brining the solid heat-exchange object into contact with first metal sheets provided with flow paths, through which the heat-exchange fluid passes (for example, by sandwiching the heat-exchange object between the first metal sheets or the like).

The present application is based on Japanese Patent Application (Patent Application No. 2009-165220) filed on 14 Jul. 2009, and the content thereof is incorporated herein as reference.

INDUSTRIAL APPLICABILITY

The present invention can be used as a heat exchanger capable of performing heat exchange between a heat-exchange fluid and a heat-exchange object.

REFERENCE SIGNS LIST

1. Heat exchanger
10. Flow path structure member
11. First metal sheet
12. Second metal sheet
R1, R2. Flow path

The invention claimed is:

1. A heat exchanger for performing heat exchange between a heat-exchange fluid flowing through a flow path having a pair of opposing side surfaces and a heat-exchange object located outside the flow path, wherein the pair of opposing side surfaces of the flow path are formed with alternating pairs of recessed portions and pairs of protruding portions, the flow path is further formed by a planar surface positioned between a pair of the pairs of recessed portions and extending downstream along the flow path from the pair of recessed portions to a position between a downstream pair of protruding portions of the pairs of protruding portions, and the flow path being formed such that a distance between the downstream pair of protruding portions of the pair of side surfaces is narrower than a distance between the pair of recessed portions along a flow direction, and depths of the flow path at all locations between the pair of recessed portions, as measured from the planar surface at the position between the pair of recessed portions, is smaller than depths of the flow path at all locations between the downstream pair of protruding portions, as measured from the planar surface at the position between the downstream pair of the protruding portions of the pair of side surfaces.

2. The heat exchanger according to claim 1, wherein the flow path is formed such that an area of a cross section orthogonal to the flow direction is constant.

3. The heat exchanger according to claim 1, wherein the flow path is formed such that the alternating pairs of recessed portions and pairs of protruding portions of the opposing side surfaces are rectangular in shape.

4. A heat exchanger for performing heat exchange between a heat-exchange fluid flowing through a flow path having a pair of opposing side surfaces and a heat-exchange object located outside the flow path, wherein the pair of opposing side surfaces of the flow path are formed with alternating pairs of recessed portions and pairs of protruding portions, the flow path is further formed by a planar surface positioned between a pair of the pairs of recessed portions and extending downstream along the flow path from the pair of recessed portions to a position between a downstream pair of protruding portions of the pairs of protruding portions, and the flow path being formed such that a distance between the downstream pair of protruding portions of the pair of side surfaces is narrower than a distance between the pair of recessed portions along a flow direction, a depth of the flow path between the pair of recessed portions, as measured from the planar surface at the position between the pair of recessed portions, is smaller than a depth of the flow path between the downstream pair of protruding portions, as measured from the planar surface at the position between the downstream pair of the protruding portions of the pair of side surfaces, and a change from the distance between the pair of recessed portions to the narrower distance between the protruding portions occurs at a common location where the depth changes from the smaller depth between the protruding portions to the depth between the downstream protruding portions.

5. The heat exchanger according to claim 4, wherein the flow path is formed such that an area of a cross section orthogonal to the flow direction is constant.

6. The heat exchanger according to claim 4, wherein the flow path is formed such that the alternating pairs of recessed portions and pairs of protruding portions of the opposing side surfaces are rectangular in shape.

* * * * *